US006404411B1

(12) United States Patent
Masuda et al.

(10) Patent No.: US 6,404,411 B1
(45) Date of Patent: Jun. 11, 2002

(54) DISPLAY PANEL DRIVING METHOD AND DISCHARGE TYPE DISPLAY APPARATUS

(75) Inventors: Takeo Masuda, Yokohama; Takashi Sasaki, Hiratsuka; Masaji Ishigaki; Hiroshi Ohtaka, both of Yokohama, all of (JP)

(73) Assignee: Hitachi, Limited, Tokyo (JP)

( * ) Notice: Subject to any disclaimer, the term of this patent is extended or adjusted under 35 U.S.C. 154(b) by 0 days.

(21) Appl. No.: 09/361,233

(22) Filed: Jul. 27, 1999

(30) Foreign Application Priority Data

Jul. 29, 1998 (JP) ..... 10-214325
Jul. 29, 1998 (JP) ..... 10-214586

(51) Int. Cl.[7] ..... G09G 3/28

(52) U.S. Cl. ..... 345/66; 345/67; 345/68; 345/69; 345/70; 315/169.1

(58) Field of Search ..... 345/66, 67, 68, 345/69, 70; 315/169.1

(56) References Cited

U.S. PATENT DOCUMENTS 5,952,986 A * 9/1999 Nguyen et al. ..... 345/68
6,020,687 A * 2/2000 Hirakawa et al. ..... 315/169.1

FOREIGN PATENT DOCUMENTS

| | | |
|---|---|---|
| EP | 549 275 A1 | 6/1993 |
| EP | 657 861 A1 | 6/1995 |
| JP | 8-278766 | 10/1996 |
| JP | 10-83160 | 3/1998 |

* cited by examiner

*Primary Examiner*—Richard Hjerpe
*Assistant Examiner*—Jean Lesperance
(74) *Attorney, Agent, or Firm*—Mattingly, Stanger & Malur, P.C.

(57) ABSTRACT

The present specification and drawings disclose a technique to display image on the display panel using subfield. Particularly, it is disclosed that the technique for conducting the reset operation by impressing, to the electrode of cells, a plurality of reset pulses per one subfield in the subfield period for the reset operation and then conducting the address operation for selecting cells for display discharge. Further, it is disclosed that the display technique for causing the cells of display panel to conduct display discharge for image display through the reset operation and address operation. Namely, it is the technique for impressing the auxiliary pulse to the electrode of cells after impression of reset pulse for reset operation to form charges in inverse voltage to the scan pulse during the address operation and then conducting the address operation for selecting the cells for display discharge.

15 Claims, 13 Drawing Sheets

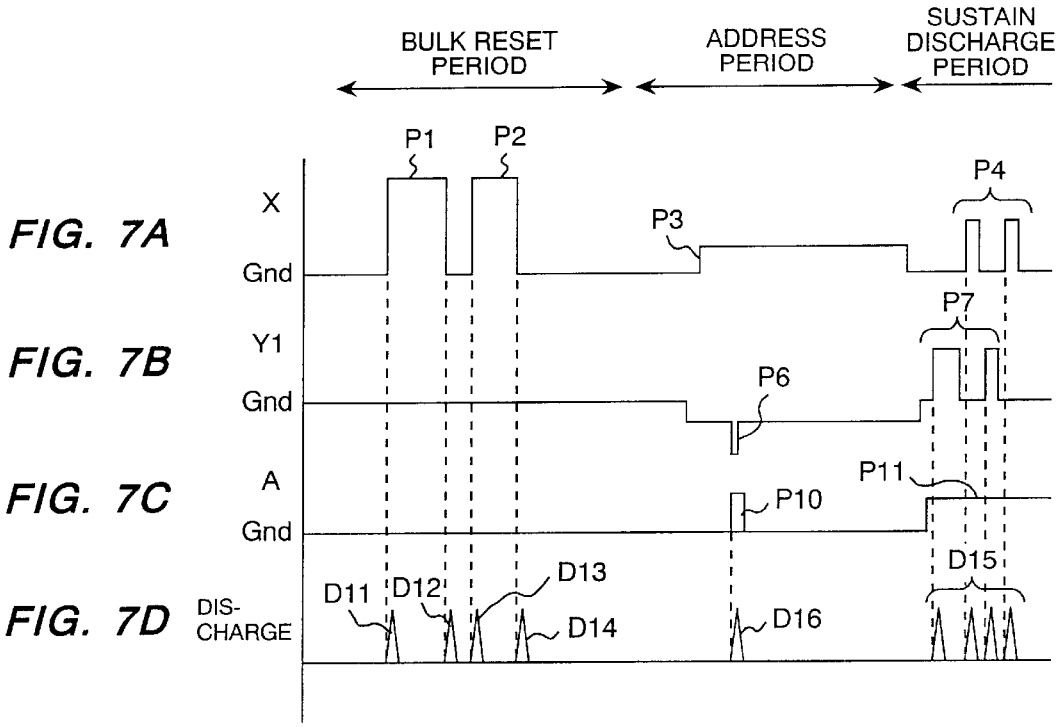
BULK RESET PERIOD
ADDRESS PERIOD
SUSTAIN DISCHARGE PERIOD
FIG. 7A
X
Gnd
P1
P2
P3
P4
FIG. 7B
Y1
Gnd
P6
P7
FIG. 7C
A
Gnd
P10
P11
FIG. 7D
DIS-CHARGE
D11
D12
D13
D14
D15
D16
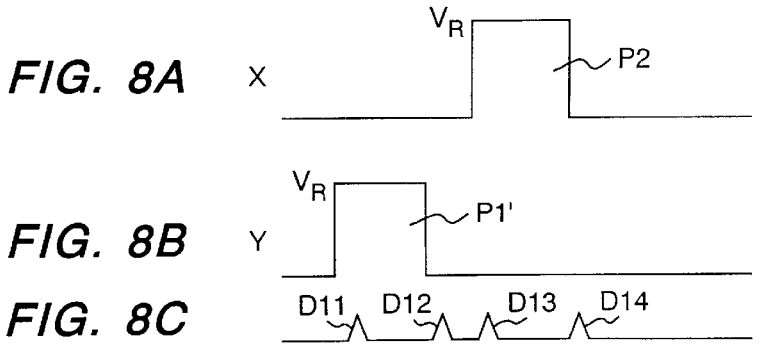
FIG. 8A
X
$V_R$
P2
FIG. 8B
Y
$V_R$
P1'
FIG. 8C
D11
D12
D13
D14

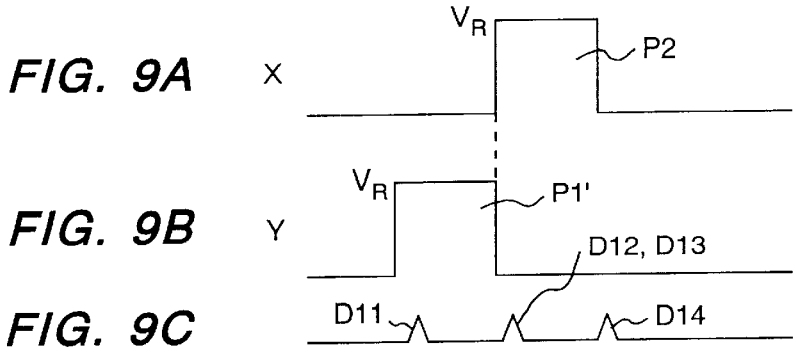
FIG. 9A
X
$V_R$
P2
FIG. 9B
Y
$V_R$
P1'
D12, D13
FIG. 9C
D11
D14
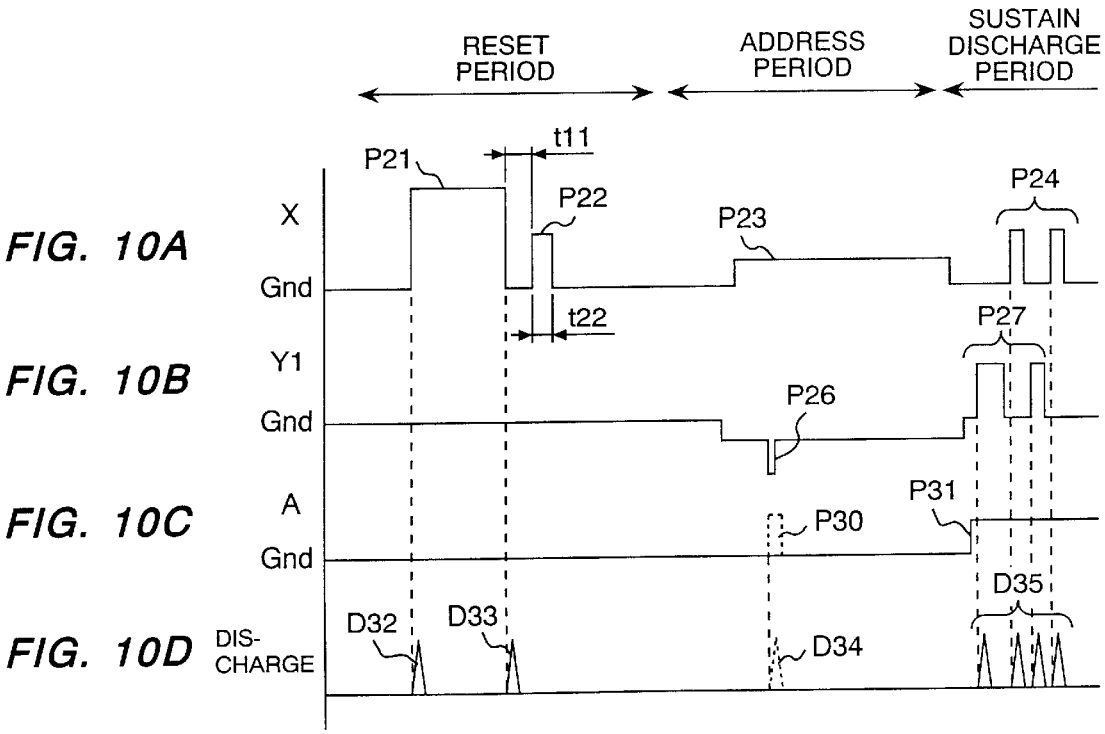
RESET PERIOD
ADDRESS PERIOD
SUSTAIN DISCHARGE PERIOD
FIG. 10A
X
Gnd
P21
t11
P22
t22
P23
P24
FIG. 10B
Y1
Gnd
P26
P27
FIG. 10C
A
Gnd
P30
P31
FIG. 10D
DIS-CHARGE
D32
D33
D34
D35

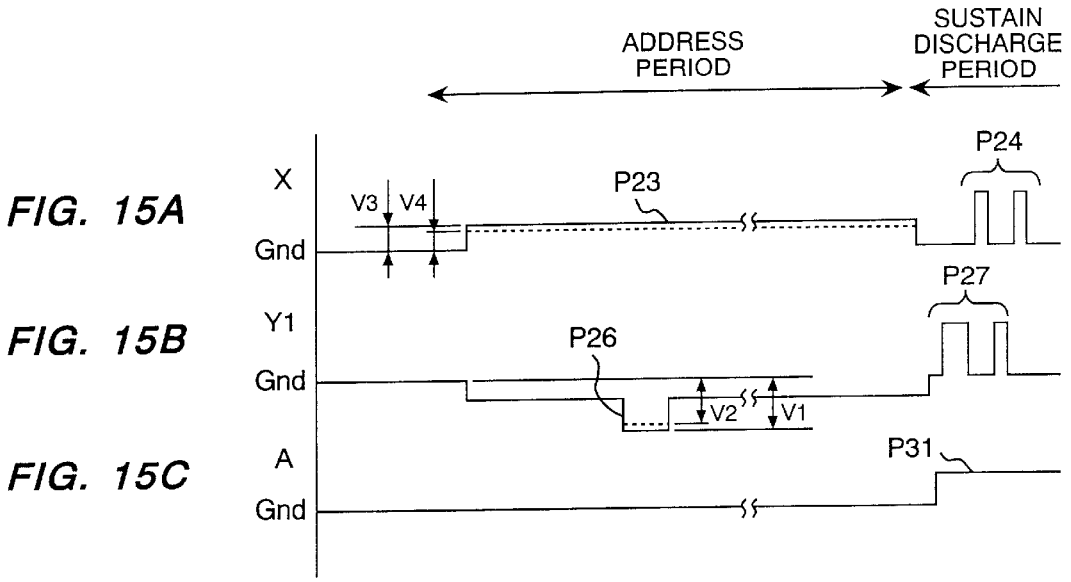
ADDRESS PERIOD
SUSTAIN DISCHARGE PERIOD
FIG. 15A
X
Gnd
V3
V4
P23
P24
FIG. 15B
Y1
Gnd
P26
V2
V1
P27
FIG. 15C
A
Gnd
P31
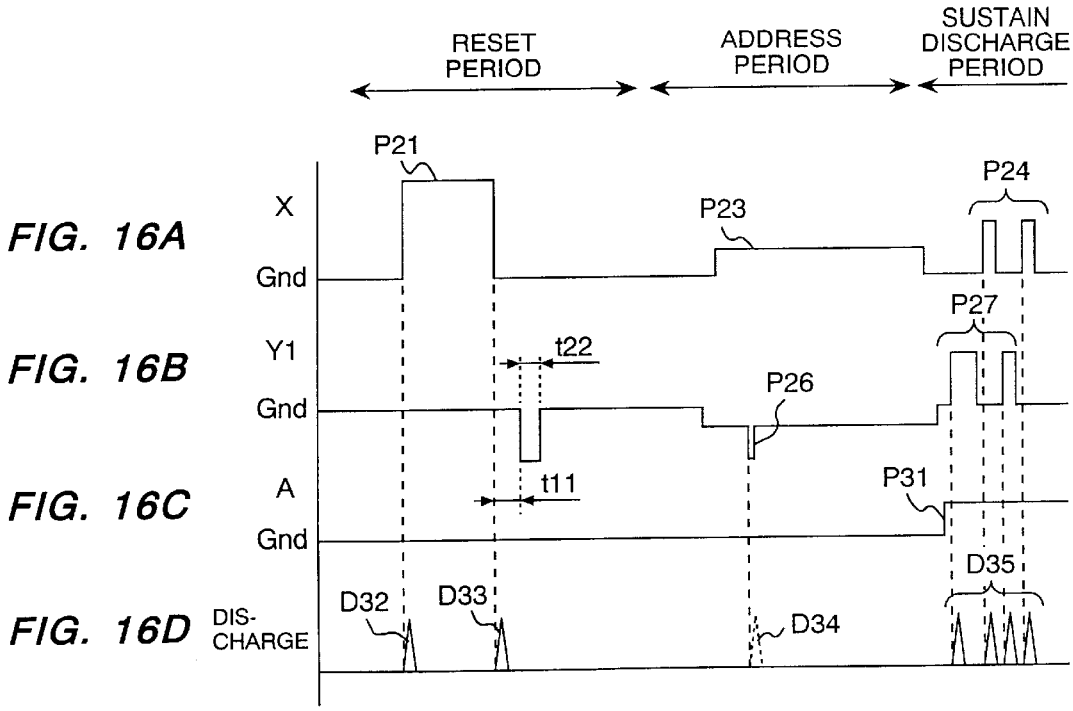
RESET PERIOD
ADDRESS PERIOD
SUSTAIN DISCHARGE PERIOD
FIG. 16A
X
Gnd
P21
P23
P24
FIG. 16B
Y1
Gnd
t22
P26
P27
FIG. 16C
A
Gnd
t11
P31
FIG. 16D
DIS-CHARGE
D32
D33
D34
D35

DISPLAY PANEL DRIVING METHOD AND DISCHARGE TYPE DISPLAY APPARATUS

BACKGROUND OF THE INVENTION

1. Field of the Invention

The present invention relates to a discharge type display technology, for example, to a display technique of plasma display panel to be introduced, to a display apparatus of personal computer and workstation or to a flat type wall-mounted television receiver, and moreover, relates to a technique of advertisement and information display apparatus or the like.

2. Description of the Related Art

A plasma display apparatus, for example, realizes display of physically thinner structure in place of display of the physically thick structure such as existing CRT system, and it is particularly expected as a large size display system.

For example, in the plasma display apparatus, one field (a sheet of display image) is divided into a plurality of subfields for every luminance and ultraviolet ray is generated by discharge for every pixel (display cell) to excite phosphor for the purpose of light emission. This discharge is called a sustain discharge and half tone is displayed by changing the number of times of this discharge for every subfield. In such a plasma display apparatus, since the electric charge particles accumulated in the discharge area (display cell) are eliminated (controlled) first in the first reset period of each subfield in order to display an image of one field (a sheet of display image), the reset pulse is impressed to the entire part of display screen (all cells) to generate the write discharge and self erasing discharge. After the reset period, the cells to be displayed by light emission is selected (addressed) on the display screen by utilizing the period called the address period before the sustain discharge explained above. Namely, the scan pulse is impressed to the scan electrode comprising, for example, of Y electrode and the address pulse is impressed to the address electrode which are arranged on the display screen.

As explained above, in the plasma display panel, the cells for display on the display screen are selected by impressing the scan pulse to the address electrode comprising Y electrode and thereafter an image is displayed by conducting sustain discharge on these selected cells.

At the beginning of each subfield, the write discharge and erase discharge have been conducted for the entire surface to erase the charged particles accumulated in the discharge area (display cells) without relation to whether the sustain discharge is conducted or not on the immediately preceding subfield. However, since light emission by such discharges occurs on all cells, luminance of black level rises particularly, resulting in deterioration of contrast. Therefore, for example, the Japanese Unexamined Patent Publication No. Hei 8-278766 describes the technique to erase the charges (wall charges) of only the cells in which the sustain discharge is performed in the immediately preceding subfield. This technique is intended to realize selective write discharge and self erase discharge of only the cells in which such sustain discharge is performed in the immediately preceding subfield in view of preventing deterioration of contrast. Even in this technique, the write discharge and erase discharge are performed for the entire surface to erase charges accumulated in the cells in the reset period of the first subfield of a plurality of subfields forming one field (a sheet of display image).

However, in the related technique explained above, intervals between adjacent upper and lower display cells and right and left lower display cells is narrowed particularly with miniaturization of cell structure requested by improvement for high definition of plasma display panel. Therefore, influence (so-called crosstalk) on the adjacent upper and lower cells and right and left cells due to the charges generated at the time of discharge of each cell becomes large. There arises a problem that it is difficult for each cell to perform normal operation, namely unwanted light emission by erroneous discharge and non-lighting of required cells are generated.

The Japanese Unexamined Patent Publication No. Hei 8-278766 certain discloses that the write discharge and erase discharge are performed selectively at the cells where the sustain discharge explained above is performed. However, in this related art, charges are perfectly erased, not considering that charges generated by self erase discharge are utilized in order to stabilize the next discharge.

SUMMARY OF THE INVENTION

The inventors of the present invention have confirmed by experiments that influence on the upper and lower neighboring display cells by the generated charges tends to become larger as fluctuation of time lag of discharge at the time of the bulk reset discharge becomes larger. When time lag of discharge becomes larger, normal address discharge can no longer be conducted during the address period following this reset discharge and thereby displayed image quality is deteriorated. Moreover, the inventors have also confirmed that influence on the right and left neighboring display cells is caused by erroneous discharge due to the crosstalk when the address discharge is generated. The displayed image quality by such erroneous discharge is deteriorated.

The present invention has been proposed by the inventors who have recognized a problem that displayed image quality is deteriorated due to non-uniform time lag of discharge when bulk reset discharge is conducted. In more practical, it is an object of the present invention to provide display technique for providing high quality display image on the high definition display screen by realizing stable address discharge through control of non-uniform time lag of discharge when the bulk reset discharge is generated in order to reduce crosstalk as the influence applied on the upper and lower neighboring cells. Moreover, the displayed image quality is deteriorated by erroneous discharge by the crosstalk generated when the address discharge is conducted. It is also an object of the present invention to provide display technique for providing high definition display screen and high quality display image. That is implemented by realizing stable address discharge through impression of voltage to accumulate charges in the polarity different from that of the voltage. The voltage is impressed when address discharge is conducted after the reset discharge in order to reduce erroneous discharge by the crosstalk in the left and right neighboring display cells.

Moreover, it is another object of the present invention to provide display technique for preventing deterioration of contrast by preventing erroneous discharge due to impression of scan pulse.

In order to attain the objects explained above, the present invention assures that:

(1) a discharge type display apparatus for displaying images on the display panel by selecting the cells for display discharge after the reset operation is provided with the structure that the pulse to conduct the preliminary process for selection is impressed to the electrode of cells during the period before the selection after impression of the first reset pulse;

(2) a display panel driving method for displaying images on the display panel using the subfields comprises the step of conducting the address operation to select the cells for display discharge after conducting the reset operation by impressing a plurality of reset pulses in every subfield to the electrode of cells during the subfield period for conducting the reset operation;

(3) a plurality of reset pulses are impressed to the same electrode in the item (2);

(4) in item (3), a couple of reset pulses are impressed and the second reset pulse is impressed within the period of 1 μs to several tens μs after completion of the first reset pulse;

(5) a plurality of reset pulses are impressed to different electrodes in item (2);

(6) in item (2), the end of impression of the first reset pulse among a plurality of reset pulses is almost matched with the start of impression of the next reset pulse;

(7) a discharge type display apparatus for displaying images on the display panel using the subfield is provided with a structure that a plurality of reset pulses are impressed in every subfield for the reset operation to the electrode of cell of display panel in the subfield period for the reset operation;

(8) a plurality of reset pulses are impressed to the game electrode in item (7);

(9) in item (7), a plurality of reset pulses are composed of two reset pulses and the second reset pulse is impressed within the period of 1 μs to several tens μs after the end of the first reset pulse;

(10) in item (7), a plurality of reset pulses are impressed to different electrodes;

(11) in item (7), the end of impression of the first reset pulse among a plurality of reset pulses is almost matched with the start of impression of the next reset pulse;

(12) a display panel driving method for executing display discharge for image display to the cells of the display panel through the reset operation and address operation comprises the step of impressing an auxiliary pulse, after impression of reset pulse for reset operation, to the electrode of cells to form the charges in the inverse potential from the scan pulse during the address operation and then conducting the address operation for selecting the cells for display discharge;

(13) the auxiliary pulse is impressed within the period of 1 to 3 μs after the end of impression of the reset pulse in item (12);

(14) the auxiliary pulse is impressed corresponding to the number of times of immediately preceding display discharge in item (13);

(15) the auxiliary pulse has the pulse duration of 5 to 30 μs in item (12);

(16) the auxiliary pulse is impressed to the electrode same as that to which the reset pulse is impressed in item (12);

(17) the auxiliary pulse is impressed to the electrode same as that to which the scan pulse is impressed in item (12);

(18) a discharge type display apparatus for displaying images by the display discharge on the cells of display panel by conducting the reset operation and address operation impresses, after impression of the reset pulse for reset operation, the auxiliary pulse to form charges in the inverse potential from the scan pulse during the address operation;

(19) the auxiliary pulse is impressed in the period from 1 to 3 μs after the end of impression of the reset pulse in item (18);

(20) the auxiliary pulse is impressed at the timing corresponding to the number of times of immediately preceding display discharge in item (18);

(21) the auxiliary pulse has the pulse duration of 5 to 30 μs in item (18);

(22) the auxiliary pulse is impressed to the electrode same as that to which the reset pulse is impressed in item (18);

(23) the auxiliary pulse is impressed to the electrode same as that to which the scan pulse is impressed in item (18);

(24) a discharge type display apparatus including a structure of subfield display system for displaying images by display discharge of cells of the display panel by conducting the reset operation and address operation impresses, to the electrode of cells, a plurality of reset pulses in every subfield for the reset operation during the subfield period for the reset operation and also impresses the auxiliary pulse, after impression of the reset pulse, to form charges of the inverse potential to the scan pulse during the address operation.

BRIEF DESCRIPTION OF THE DRAWINGS

FIG. 7 is a diagram illustrating driving pulse waveforms of a plasma display panel;

FIG. 8 is a diagram illustrating another embodiment of the present invention;

FIG. 9 is a diagram illustrating the other embodiment of the present inventions FIG. 10 is a diagram for explaining a plasma display panel driving method as an embodiment of the present invention;

FIG. 15 is a diagram illustrating waveforms for driving the plasma display panel electrodes; and FIG. 16 is a diagram illustrating waveforms for driving the plasma display panel electrodes.

DETAILED DESCRIPTION OF THE PREFERRED EMBODIMENT

A preferred embodiment of the present invention will be explained with reference to the accompanying drawings.

Figure 2:
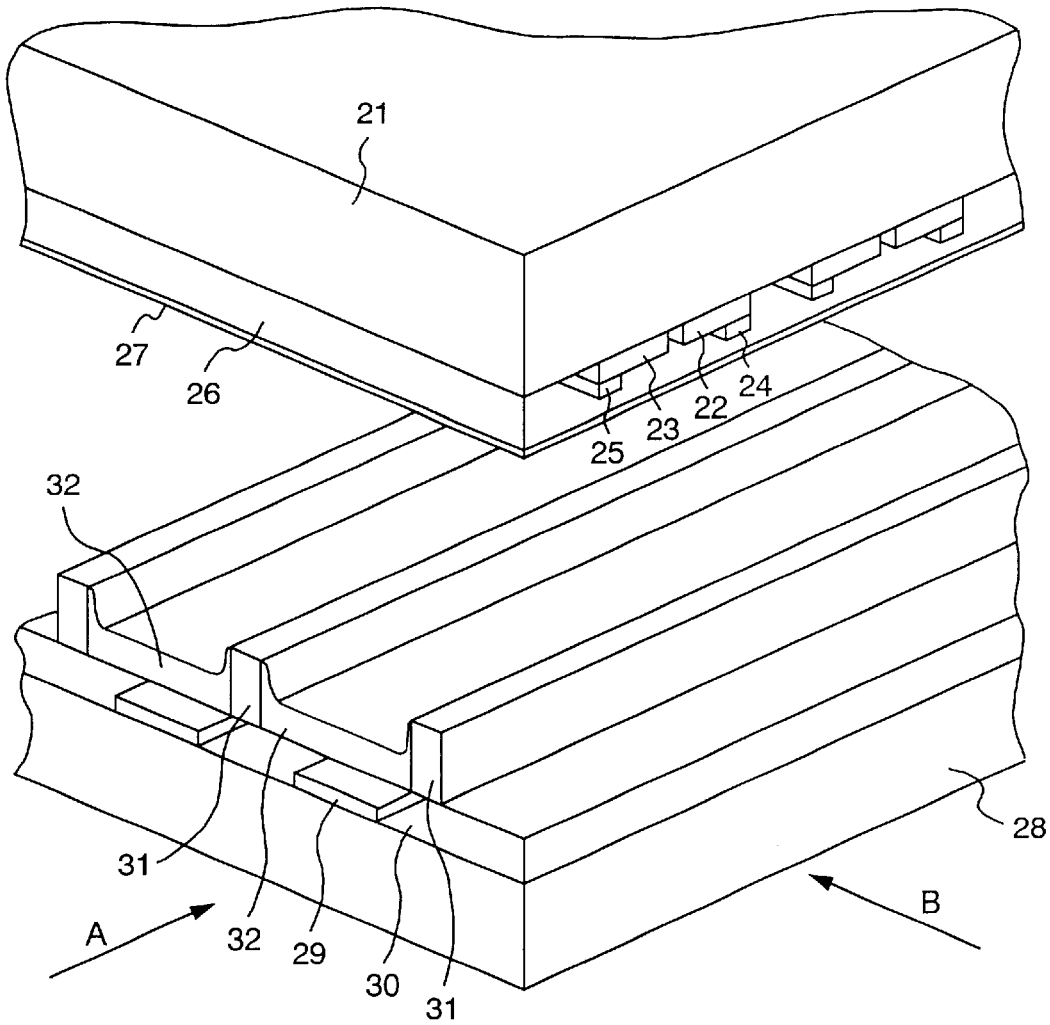
FIG. 2 is a diagram illustrating a practical structure of a plasma display panel as an embodiment of the present invention.

FIG. 2 is a diagram illustrating an example of structure of plasma display panel as a first embodiment of the present invention. In this figure, at the lower surface of a front glass substrate 21, a transparent X electrode 22 and transparent Y electrode 23 are provided mutually in parallel. Moreover, these X electrode 22 and Y electrode 23 are respectively provided with an X bus electrode 24 and a Y bus electrode 25 laminated with each other. Moreover, at the further lower surface of the bus electrodes, a dielectric layer 26 is formed and at the lower surface thereof, a protection layer 27 comprising, for example, of manganese dioxide (MgO) or the like is provided.

On the other hand, on the upper surface of a rear glass substrate 28 arranged opposed to the front glass substrate, a so-called address A electrode 29 is provided to cross in the right angle direction the X electrode 22 and Y electrode 23 of the front glass substrate 21. On this address A electrode 29, a dielectric layer 30 is provided to cover the electrode and on this upper surface, a member to form a barrier rib 31 of panel is arranged in parallel to the address A electrode 29. On the dielectric layer 30 on the address A electrode 29, phosphors 32 (for three colors of red (R), green (G) and blue (B)) are provided alternately as the coating between a pair of members forming the barrier rib 31.

Figure 3:
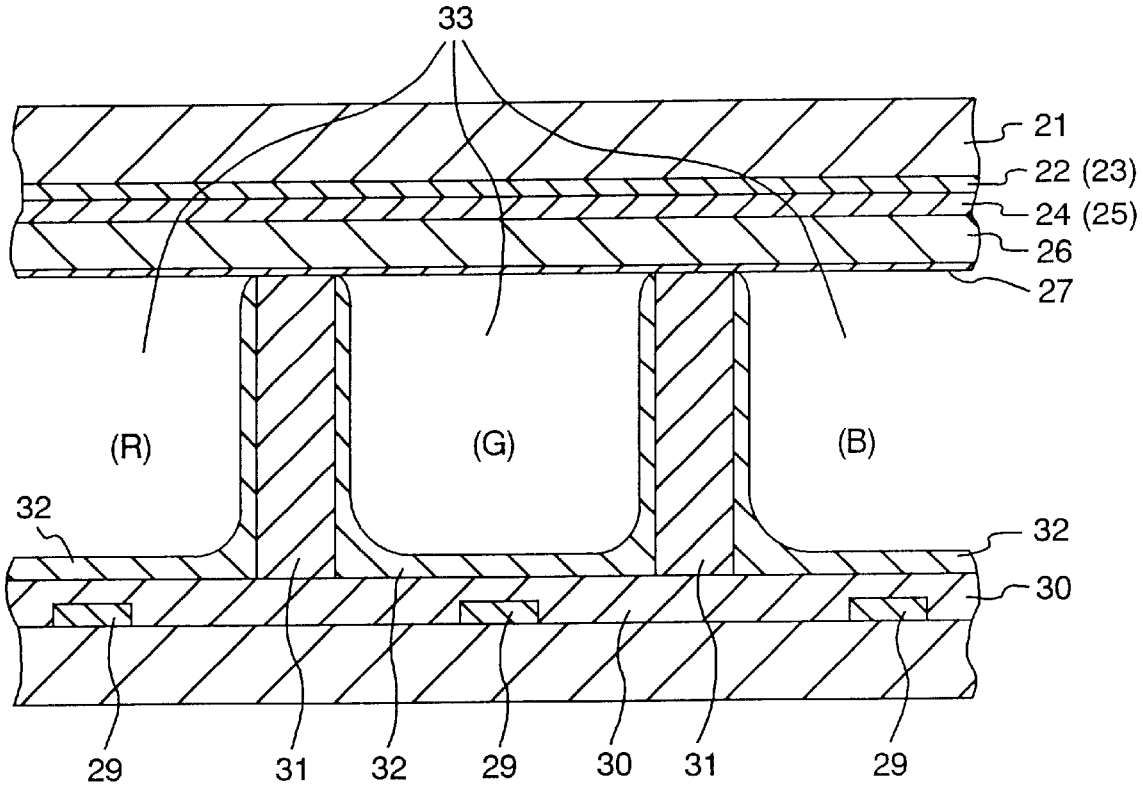
FIG. 3 is a partial enlarged cross-sectional view in the direction A in the structure of FIG. 2.

Next, the accompanying drawing FIG. 3 is a partly enlarged cross-sectional view in which particular one display cell of the plasma display panel illustrated in FIG. 2 is observed from the direction of arrow mark A of the figure. The address A electrode 29 is located at the intermediate position of a pair of barrier ribs 31, 31 and a space 33 formed between the front glass substrate 21 and rear glass substrate 28 is filled by so-called discharge gas such as Ne, Xe or the like to form the discharge space.

Figure 4:
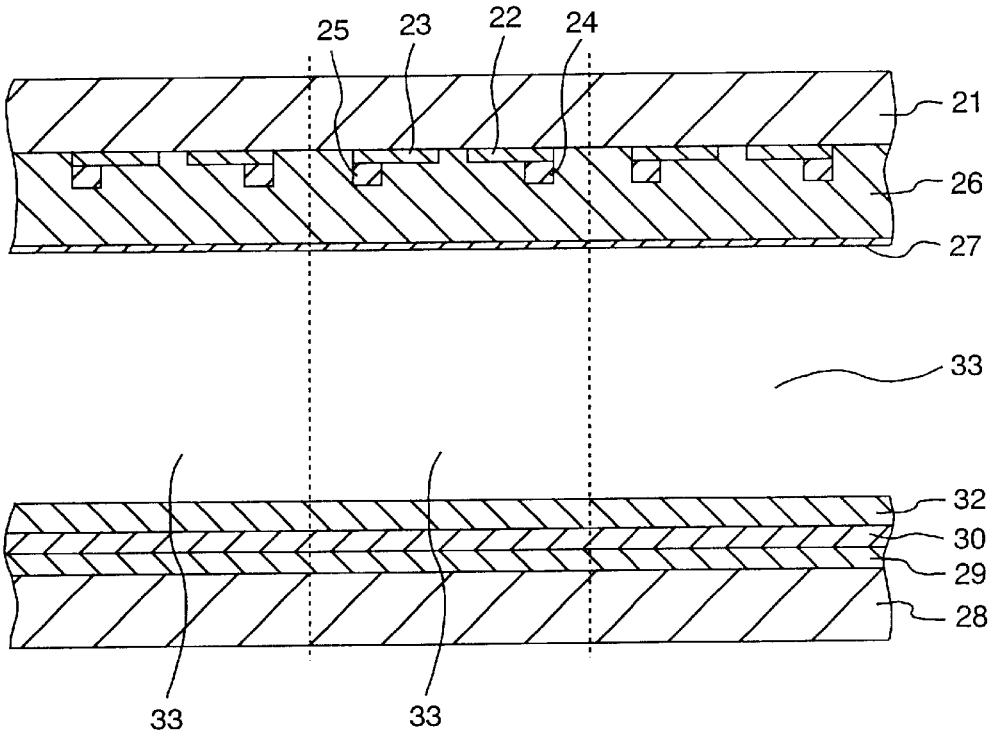
FIG. 4 is a partial enlarged cross-sectional view in the direction B in the structure of FIG. 2.

Moreover, the accompanying drawing FIG. 4 is a partly enlarged cross-sectional view of the plasma display panel of FIG. 2 in which it is observed from the direction of arrow mark B. In this figure, three discharge cells 33, 33, . . . are illustrated. Each display cell is partitioned by the boundary at the positions indicated by the dotted line in the figure and as is apparent from this figure, each display cell is sequentially and alternately provided with the X electrode 22 and the Y electrode 23 of the front glass substrate 21. In the AC type plasma display panel, charges are separately collected on the dielectric material near the X electrode 22 and Y electrode 23, in more practical, on the protection layer 27 provided at the lower surface of the dielectric layer 26 on the X electrode 22 and Y electrode 23 and the electric field for discharge is formed by utilizing such charges.

Figure 5:
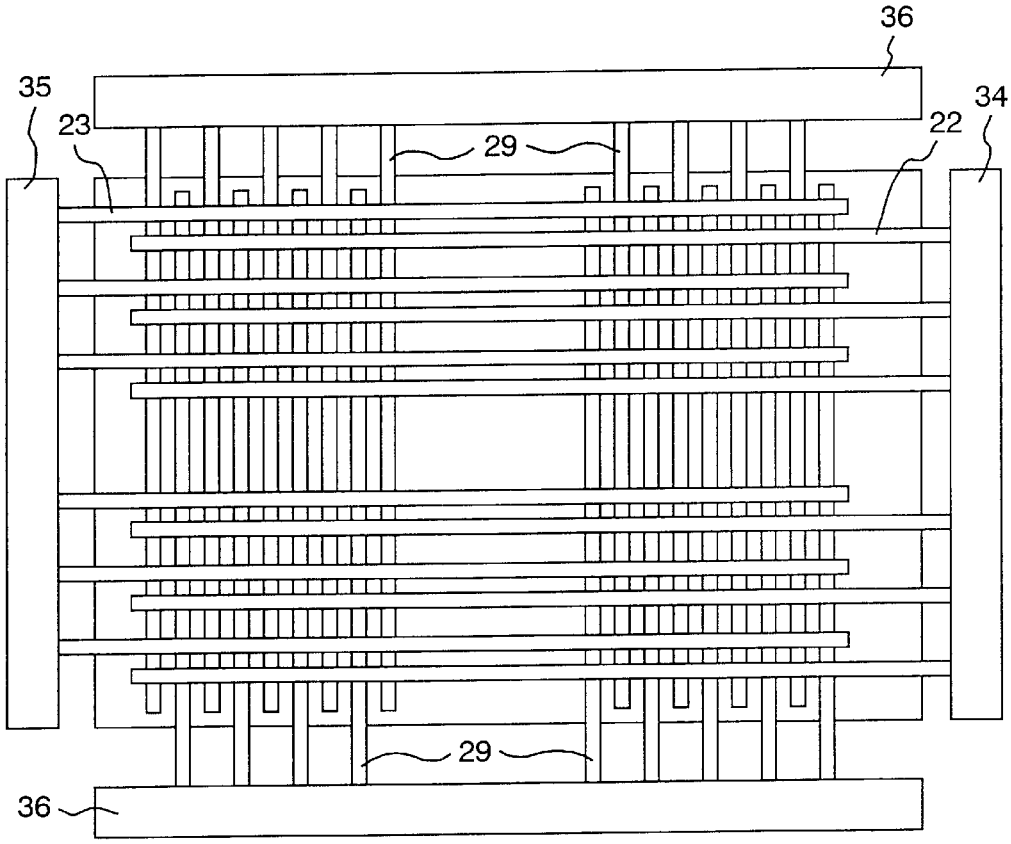
FIG. 5 is a diagram illustrating a plurality of electrode groups and circuits of a plasma display panel.

FIG. 5 is a schematic diagram illustrating a circuit structure comprising wiring of X electrode 22 and Y electrode 23 formed on the front glass substrate 21 and address A electrode 29 formed on the rear surface glass substrate 28 and circuits connected to each electrode. An X drive circuit 34 generates a drive pulse which is once impressed to a plurality of X electrodes 22 (however, in some cases this X electrode 22 is connected in common and in the other cases this X electrode 22 is divided to two kinds of electrodes of odd number and even number electrodes and are then driven individually). On the other hand, a Y drive circuit 35 generates the drive pulses for each electrode of a plurality of Y electrodes 22 and then impresses such drive pulse. Moreover, the A drive circuit 36 generates and impresses the drive pulse to each electrode of the address A electrode 29.

Figure 6:
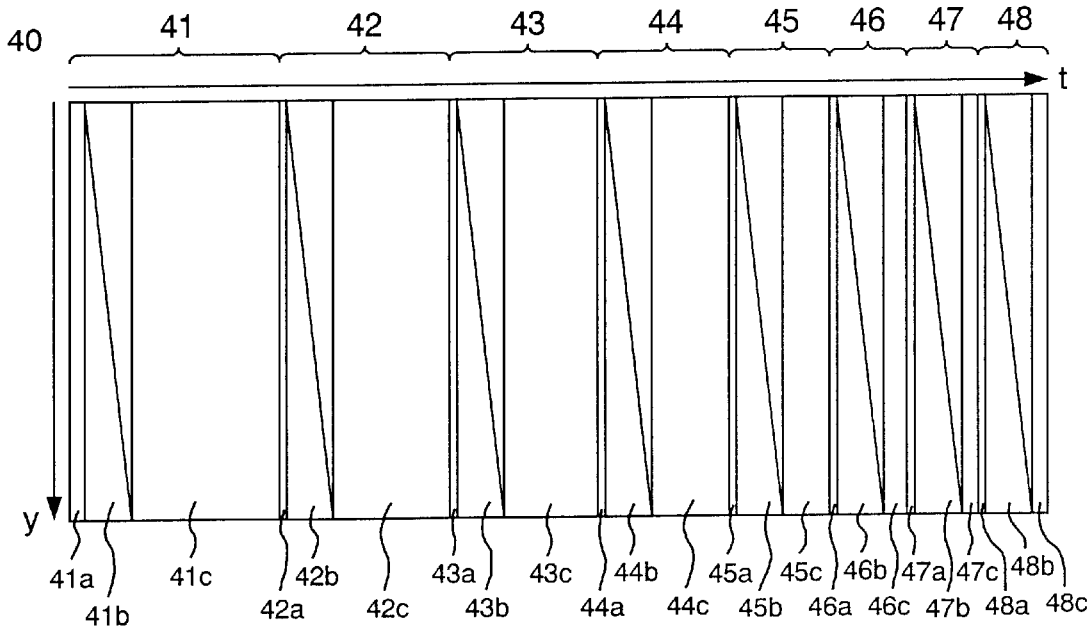
FIG. 6 is a diagram for explaining a field driving system of a plasma display panel.

FIG. 6 illustrates a field driving method as the driving method for the AC type plasma display panel explained above in its structure. In the figure, numeral 40 designates one field period, plotting the time t (time of one field period) on the horizontal axis and the row number (y) of the cells on the vertical axis (lower side). In an example of this figure, one field is divided to first to eighth subfields, namely divided to eight subfields 41 to 48.

In FIG. 6, at the beginning of the first subfield 41, the bulk reset period 41*a* is provided to conduct write discharge of all cells and self erasing discharge for erasing charges. At the beginning of the subsequent second to eighth subfields 42 to 48, the selection reset periods 42*a* to 48*a* are provided to selectively conduct write and erase discharges only for the cells in which sustain discharge is executed in the immediately preceding subfield.

Moreover, in the first to eighth subfields 41 to 48, the address periods 41*b* to 48*b* are provided following the bulk reset period 41*a* or selective reset periods 42*a* to 48*a*, moreover followed by the sustain discharge periods 41*c* to 48*c*. In the sustain periods 41*c* to 48*c*, the number of times of discharge is respectively assigned and so-called display of half tone can be realized through combination of these number of times of discharge. In addition, the number of times of discharge and sequence of subfield can be determined freely and in this embodiment, the subfields are arranged in the sequence of the larger number of times of discharge as an example.

FIG. 7 is a time chart illustrating the waveforms of the drive signal of each electrode particularly in the first subfield 41 illustrated in FIG. 6.

The signal waveforms illustrated in FIG. 7A are a part of the drive signal waveform to be impressed to the X electrode 22 in the bulk reset period 41*a* of the first subfield 41. Moreover, FIG. 7B illustrates a part of the drive signal waveform to be impressed to a part of the neighboring Y electrodes 23 (for example, Y1 electrode 23 of the first row). The signal waveform illustrated in FIG. 7C illustrates a part of the drive signal waveform to be impressed to one address A electrode 29, while the signal waveform illustrated in FIG. 7D illustrates emission of light by discharge generated in the cells due to impression of the pulse signal explained above.

Here, the signal waveform to be impressed to the X electrode 22 in the bulk reset period 41*a* of the first subfield 41 explained above includes the bulk reset pulses P1, P2, as illustrated in FIG. 7A, to generate the self erase discharge on all discharge cells. According to the present invention, as will be apparent from the figure, this bulk reset pulses P1, P2 are respectively formed of two reset pulses and thereby the reset pulse is impressed to the X electrode 22 at least twice continuously. These bulk reset pulses P1, P2 causes all display cells to surely generate discharge without relation to existence of charges in each display cell and its amplitude (voltage) and/or pulse width will be explained later in detail. Moreover, the signal waveform to be impressed to the X electrode 22 includes the X scan pulse P3 in the subsequent address period 41*b* and also includes the predetermined number of sustain pulse P4 having the predetermined voltage and width in the subsequent sustain discharge period 41*c*.

Moreover the signal waveform to be impressed to the Y1 electrode 23 includes, as illustrated in FIG. 7B, a negative scan pulse P6 to select the display cells to emit the light in the address period 41*b* following the reset period 41*a* and also includes the predetermined number of sustain pulse P7 having the predetermined voltage and width in the subsequent sustain discharge period 41*c*.

Furthermore, the signal waveform impressed to the address A electrode 29 is illustrated in FIG. 7C and this waveform includes the total pulse P11 corresponding to the sustain pulses P4 and P7 to be impressed to the X electrode 23 and Y1 electrode 23 in the sustain discharge period 41*c*. In addition, the address pulse P10 is impressed corresponding to the scan pulse P6 for selecting the discharge panel. FIG. 7D illustrates the light emitting operation by the discharge generated within the discharge space (display cells) with various kinds of drive pulses explained above.

Figures 1A, 1B, 1C, 1D:
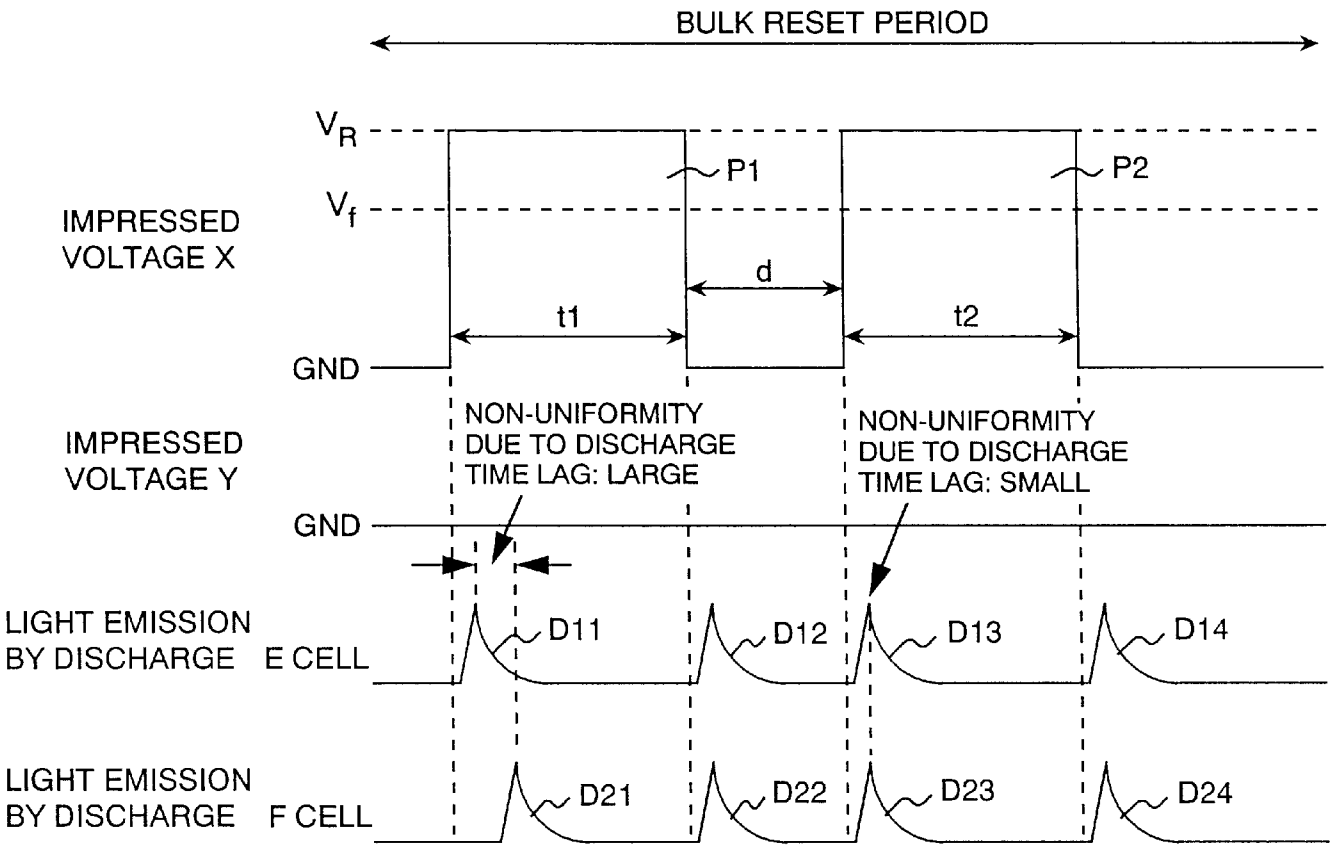
FIG. 1 is a diagram for explaining a plasma display panel driving method as an embodiment of the present invention.

Here, FIGS. 1A and 1B particularly illustrate the signal waveform (FIG. 1A) to be impressed to the X electrode 22 and signal waveform (FIG. 1B) to be impressed to the Y electrode 23 among the signal waveforms in the first subfield 41 illustrated in FIG. 7. Moreover, FIGS. 1C and 1D illustrate in detail the neighboring upper and lower display cells, namely the discharging condition at the E cell and F cell and the light emitting condition therein.

Particularly, as illustrated in FIG. 1A, the bulk reset pulse to be impressed to the X electrode 22 is formed, as explained above, of a couple of reset pulses P1, P2. According to the bulk reset pulse comprising a couple of reset pulses P1, P2, as illustrated in FIGS. 1C and 1D, discharge and resultant light emission generated by the first reset pulse P1 in the neighboring vertical cells, for example, in the E cell and F cell are generated resulting in a certain time lag depending on the charging condition in the cells as the discharge spaces. If such non-uniform discharge time lag becomes large, influence (crosstalk) by the charges existing between the neighboring display cells also becomes large. Thereby, the normal address discharge in the subsequent address period is interfered.

Therefore, in the present invention, the second reset pulse P2 is impressed to the X electrode 22, following the first reset pulse P1 as illustrated in FIG. 1A. Namely, in the present invention, the first reset pulse P1 generates discharges to all cells of the plasma display panel, but in the vertically neighboring cells, discharge D11 is generated with a comparatively small time lag at the E cell, while discharge D21 with a larger time lag at the cell F as illustrated in FIGS. 1C and 1D. Moreover, after these discharges D11, D21, so-called self erase discharges D12, D22 are generated after the predetermined time has passed from the end (falling edge) of the reset pulse P1. As will be apparent from the waveforms illustrated in the figure, the discharges D11, D21 are generated by the rising edge of the reset pulse P1 in different timings depending on the conditions of the cells as the discharge space, while the subsequent self erase discharges D12, D22 are generated almost in the same timing.

Therefore, moreover, the write discharges D12, D23 by the second reset pulse P2 are generated almost simultaneously in all cells as illustrated in the figure, namely with small non-uniformness of discharge time lag by impressing the second reset pulse P2 for the repeated discharge in the cells and thereby influence (crosstalk) by charges between the vertically neighboring display cells is reduced in order to assure the normal address discharge in the subsequent address period. The reference numeral D14, D24 in the figure indicate the light emission by the self erase discharge generated by the second reset pulse P2. In the present invention, as explained above, space discharge is generated in each display cell by the first reset pulse to define the discharge timing of the second reset pulse under the same wall charge condition.

It is enough to set the pulse width t1 of the first reset pulse P1 and the pulse width t2 of the subsequently impressed second reset pulse P2 to almost the same value, but it is more preferable to set the former pulse width larger than the latter pulse width ($t1 \geqq t2$) by considering fluctuation of discharge time lag due to the former pulse width. Moreover, the pulse widths t1, t2 of these reset pulses P1, P2 are set, by the write discharge generated by impression of these pulses, to such a value as causing the wall charge for self erase discharge generated subsequently to be deposited between electrodes. Moreover, the amplitude of these reset pulses is usually set to several hundreds volt which is higher than the discharge start voltage across the X and Y electrodes.

Moreover, if an interval d between these two reset pulses P1, P2 is too small, interference is generated between the self erase discharges D12, D22 due to the first reset pulse P1. Therefore, it is preferable to assure the interval d of at least about 1 $\mu$s. Moreover, it is enough that the interval d between these two reset pulses P1, P2 is set to a value to almost simultaneously generate the write discharges D13 and D23 caused by the second reset pulse P2. For example, such interval can be set in the range up to several tens $\mu$s, although it is different depending on the structure of each cell and discharge gas used, etc.

In above embodiment, the reset pulse is impressed twice to the same electrode, namely the X electrode 22 in order to align the discharge timing by the reset pulse in all cells, but the present invention is not limited thereto. Namely, it is also possible, as illustrated in FIG. 8A and FIG. 8B, to impress the reset pulse P1' corresponding to the reset pulse P1 to the Y electrode 23 before the reset pulse P2 is impressed to the X electrode 22. Even in the other embodiment illustrated in FIGS. 8A and 8B, the same operation, moreover the same operation and effect can be realized in the embodiment explained previously. However, detail explanation is omitted here. FIG. 8C illustrates discharge generated in the cells by the reset pulses P1' and P2 and resultant light emission.

Moreover, FIG. 9 illustrates the other embodiment of the present invention. In this embodiment, the reset pulse P1' corresponding to the reset pulse P1 impressed to the X electrode 22 in impressed to the V electrode 22 in place of such reset pulse P1 (refer to FIGS. 9A, 9B) and moreover as is apparent from FIG. 9, the end timing (falling edge) of the first reset pulse P1' is almost matched with the start (rising edge) of the second reset pulse P2. Here, the number of times of discharge generated by impression of reset pulse and resultant light emission can be reduced (by once) as illustrated in FIG. 9C by setting the falling time of the first reset pulse P1' to the value almost matched with the rising time of the second reset pulse P2. According to this process, since light emission by discharge in this reset period is generated in all cells, it can be prevented that luminance in the black level rises and it is preferable as a measure to prevent deterioration of contrast.

Next, the other embodiment will be explained with reference to FIG. 10 to FIG. 15. FIG. 10 illustrates drive voltage waveforms of each electrode in the first subfield 41 illustrated in FIG. 6.

First, the signal waveform illustrated in FIG. 10A is a part of the drive voltage waveform to be impressed to the X electrode 22 in the first subfield 41, while the signal waveform illustrated in FIG. 10B, a part of the drive voltage waveform impressed to a part of the neighboring Y electrode 23 (for example, Y1 electrode 23 of the first row in this example), the signal waveform illustrated in FIG. 10C, a part of the driving voltage waveform impressed to one of the address A electrodes 29 and the signal waveform illustrated in FIG. 10D illustrates light emission caused by the discharge generated in the cells due to impression of such pulse voltages.

Here, the voltage waveform impressed to the X electrode 22 in the subfield 41 in FIG. 7 includes, as illustrated in FIG. 10A, the bulk reset pulse P21 for generating self erase discharge in all cells in the bulk reset period 41*a* and also includes an auxiliary pulse P22 which is newly impressed to the X electrode 22 in the present invention after such discharge is completed. The bulk reset pulse P21 is set to larger values in its amplitude (voltage) and/or pulse width in comparison with the selective reset pulse P36 explained later in order to surely generate the discharge in all cells without relation to charges in each cell. Moreover, this auxiliary pulse P22 rises only for the predetermined period (pulse width) t22, as is apparent from the figure, after the predetermined time t11 has passed from the rise of the bulk reset pulse P21. In addition, the voltage waveform impressed to the X electrode 22 includes the X scan pulse P23 in the subsequent address period 41*b* and the predetermined number of sustain pulses P24 of the predetermined voltage and width in the subsequent sustain discharge period 41*c*.

Moreover, the voltage waveform impressed to the Y1 electrode 23 includes, as illustrated in FIG. 10B, the scan pulse P26 of negative polarity for address in the address period 41*b* following the reset period 41*a* and also the predetermined number of sustain pulses P27 in the predetermined voltage and width in the subsequent sustain discharge period 41*c*.

Furthermore, the voltage waveform impressed to the address A electrode 29 is illustrated in FIG. 10C. This waveform includes the total pulse P31 corresponding to the sustain pulses 23 in the sustain discharge period 41*c*. In addition, for selection of cells, the address pulse P30 indicated by a broken line is impressed in combination with the scan pulse P26.

FIG. 11 illustrates the drive voltage waveforms impressed to each electrode in the subfields 43 to 48 after the second subfield 42. Particularly, the drive voltage waveform of each electrode in the second subfield 42 is a typical waveform.

Figures 11A, 11B, 11C, 11D:
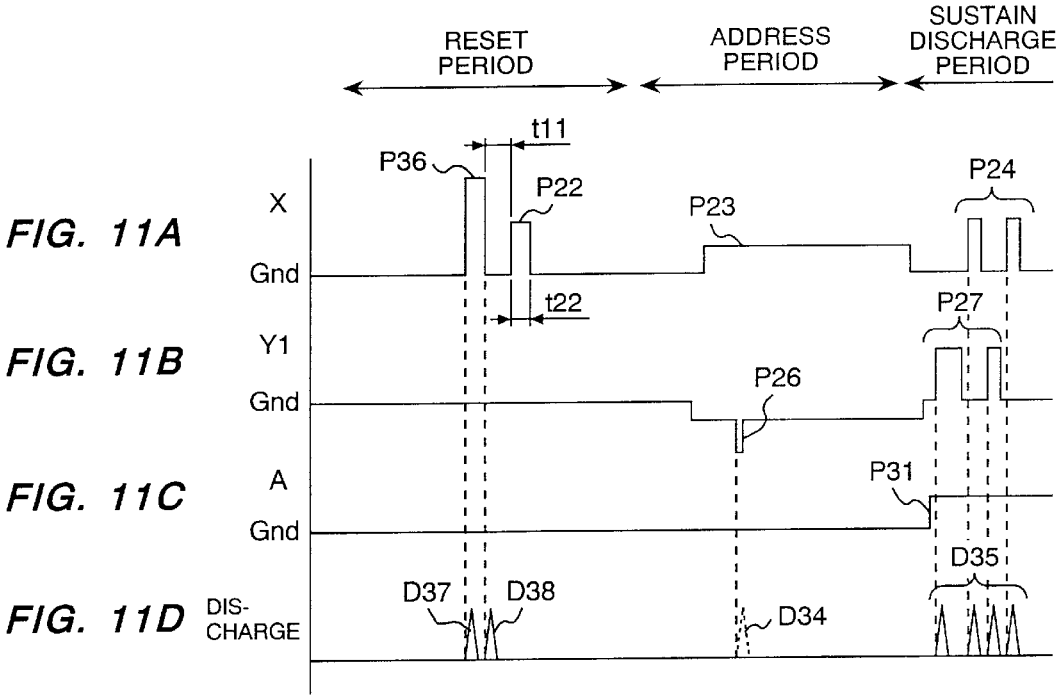
FIG. 11 is a diagram for explaining a plasma display panel driving method as an embodiment of the present invention.

First, the signal waveform illustrated in FIG. 11A is a part of the drive voltage waveform impressed to the X electrode 22 in the second subfield 42. The signal waveform illustrated in FIG. 11B is a part of the drive voltage waveform impressed to a part of the Y electrode 23 adjacent to the X electrode 22 (for example, Y1 electrode 23 of the first row), while the signal waveform illustrated in FIG. 11C, a part of the drive voltage waveform impressed to one address A electrode 29 and the signal waveform illustrated in FIG. 11D indicates light emission by the discharge generated in the cells when the pulse voltages are impressed.

Here, the voltage waveform, for example, impressed to the X electrode 22 in the second subfield 42 in FIG. 7 includes, unlike the bulk reset pulse P21, a selective reset pulse P36, as illustrated in FIG. 11A, for discharging immediately preceding subfield when it is sustain charged and also includes the auxiliary pulse P22 impressed, in the present invention, to the X electrode 22 after the charges are discharged. This selective reset pulse P36 selectively discharges to erase the charges (wall charges) of only the cells for which the sustain discharge is conducted in the immediately preceding subfield as explained above. Therefore, this selective reset pulse P36 is set in smaller amplitude (voltage) and/or pulse width in comparison with the bulk reset pulse P21 to surely generate discharges in all cells. Moreover, the auxiliary pulse P22 following the selective reset pulse P36 is a pulse voltage rising only for the predetermined period (pulse width) t12 after the predetermined time t11 has passed from the falling of the selective reset pulse P36 as explained above. In addition, also as explained previously, the voltage waveform impressed to the X electrode 22 includes the X scan pulse P23 in the subsequent address period 41*b* and also the predetermined number of sustain pulses P2 in the predetermined voltage and width in the subsequent sustain discharge period 41*c*.

Moreover, even in the second subfield 42 (and the subsequent subfields 43 to 48), the voltage waveforms similar to those explained above are impressed respectively to the Y1 electrode 23 and address A electrode 29. Namely, the voltage waveform impressed to the Y1 electrode 21 includes, as illustrated in FIG. 11B, the address pulse P26 of negative polarity in the address period 42*b* following the selective reset period 42*a* and also includes the predetermined number of sustain pulses P27 having the predetermined voltage and width in the subsequent sustain discharge period 42*c*. Moreover, the voltage waveform impressed to the address A electrode 29 includes, as illustrated in FIG. 11C, the total pulse P31 corresponding to the sustain pulses P24 and P27 impressed to the X electrode 22 and Y1 electrode 23 in the sustain discharge period 42*c*.

Continuously, a method of driving the plasma display panel as an embodiment of the present invention using various kinds of driving voltages explained in regard to FIGS. 10A to 10C and FIGS. 11A to 11C, particularly discharge of cells (pixels) will be explained with reference to FIG. 10D, FIG. 11D and FIGS. 12 to 15. Motion of charges is illustrated in FIG. 12 to FIG. 14, but in these figures, motion of charges in the center cell among three areas (cells) illustrated in these figures is illustrated.

First, as illustrated in FIG. 10A, since the bulk reset pulse P21 is impressed to the X electrode 22 of cells in the bulk reset period 41*a* in the subfield 41 in FIG. 7, the bulk reset (full write) discharge D32 and self erase discharge D33 are generated as illustrated in FIG. 10D at the rising and falling edges of such bulk reset pulse P21. Motion of charges in this case is illustrated in FIG. 12 and FIG. 13.

Figure 12:
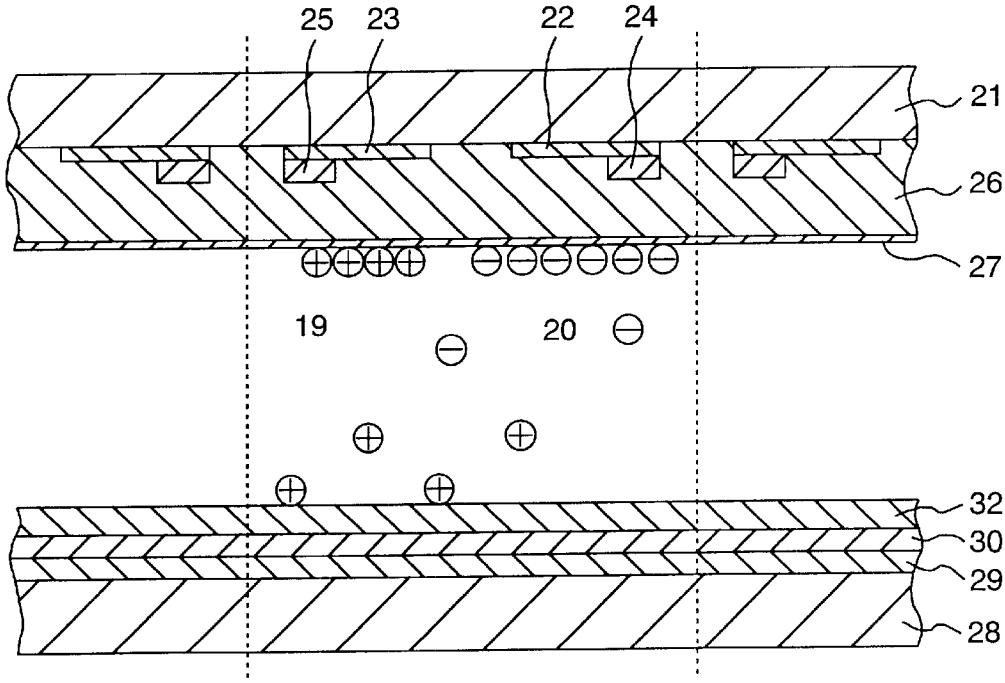
FIG. 12 is a diagram illustrating motion of charged particles in the plasma display panel.

As illustrated in FIG. 12, when the bulk reset pulse P21 is impressed to the X electrode 22 in the bulk reset period 41*a* of the subfield 41, the bulk reset discharge D32 is generated by the rising edge of the voltage (caused by thin bulk reset pulse P21. In regard to the charges generated by the bulk reset discharge, the charges are collected on the dielectric layer 26 at the area near the Y electrode 23 by impression of the bulk reset pulse P21. In more practical, as illustrated in the figure by the numeral 19, positive charges are collected on the protection layer 27 at the lower side of the Y electrode 23. On the other hand, negative charges 20 are collected on the dielectric layer 26 at the area near the X electrode 22 (namely, on the protection layer 27 at the lower side of the X electrode 22).

Figure 13:
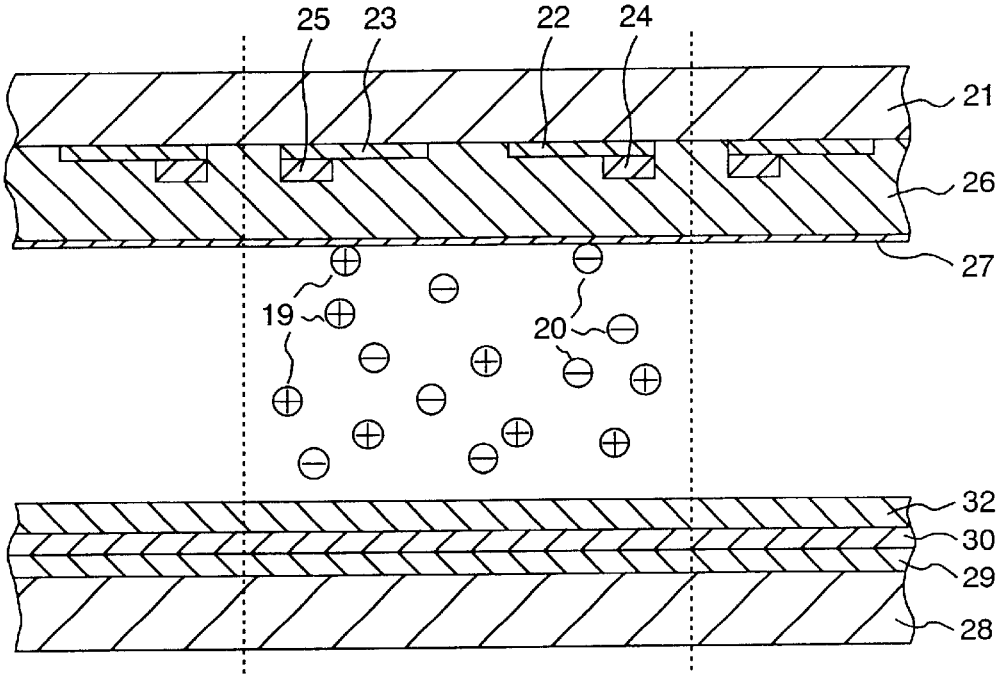
FIG. 13 is a diagram illustrating motion of charged particles in the plasma display panel.
Figure 14:
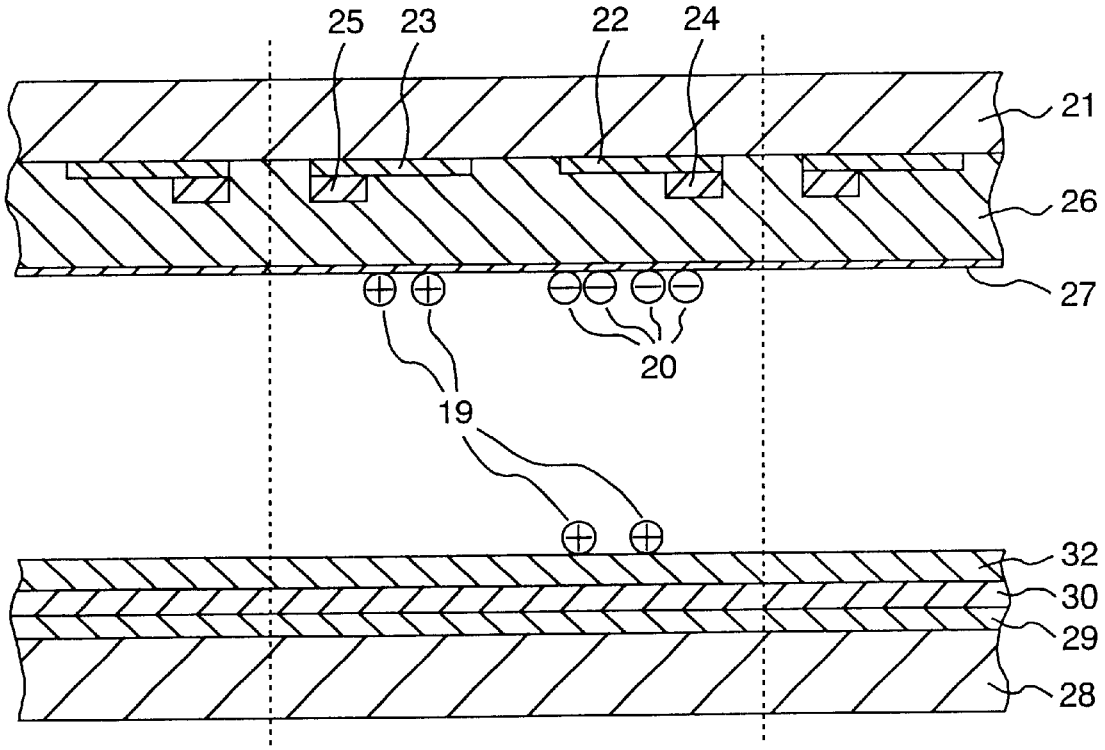
FIG. 14 is a diagram illustrating motion of charged particles in the plasma display panel.

Moreover, au is also illustrated in FIG. 10D, the self erase discharge D33 is generated at the end (falling) of the bulk reset pulse P21 and the condition of charges after generation of self erase discharge is illustrated in FIG. 13. As is apparent from the figure, in this case, charges on the dielectric layer 26 (in more practical, on the protection layer 27) are neutralized to disappear by the self discharge during the discharge period. However, since any voltage is never applied to any electrode after this discharge, charges generated by discharge (positive charges 19 and negative charges 20) strays within the discharge space and these are neutralized to disappear through the process that these charges are attracting with each other.

Therefore, in the present invention, as illustrated in FIG. 10A, an auxiliary pulse P22 in such a voltage as not generating discharge on the X electrode 22 is further impressed after the end (falling) of the bulk reset pulse P21. Namely, when the auxiliary pulse P22 is impressed to the X electrode 22, a part of the negative charges 20 among the charges straying in the discharge space in the cells after the end (falling) of the bulk reset pulse P21 is collected, as illustrated in FIG. 14, on the dielectric layer 26 (on the protection layer 27 under the X electrode 22) at the area near the X electrode 22, while a part of the positive charges 19 is collected on the dielectric layer 26 (on the protection layer 27 under the Y electrode 23) at the area near the Y electrode 23 and a part of the positive charges 19 is further collected on the dielectric layer 30 at the area near the wiring of the address A electrode 29 formed on the rear surface glass substrate 28 (namely, on the phosphor 32 on the address A electrode 29).

As a result, the negative charges 20 collected on the dielectric layer 26 at the area near the X electrode 22 (on the protection layer 27 under the X electrode 22) drop the X scan pulse P23 impressed to the X electrode 22 in the address period after the bulk reset period as indicated by a broken line in FIG. 15 to the value V4 smaller than the actually impressed voltage value V3.

On the other hand, the positive charges 19 collected on the dielectric layer 26 at the area near the Y electrode 23 (on the protection layer 27 under the X electrode 22) drop the scan pulse P26 of the negative polarity impressed to the Y1 electrode 23 in the address period after the bulk reset period to the value V2 smaller than the actually impressed voltage value V1 as indicated by the broken line of FIG. 15.

Namely, when the negative scan pulse P26 to be impressed to select the display cells for generating main discharge in the subsequent sustain discharge period is applied to the Y1 electrode 23 in the address period, generation of erroneous discharge of discharge cells by the scan pulse P26 for address can be prevented due to the effect for lowering the applied is voltage by such charges. In FIG. 10D, when the auxiliary pulse P22 of the present invention is not applied, light emission by erroneous discharge generated when the negative scan pulse P26 is impressed to the Y1 electrode 23 is indicated by a broken line D34 for the reference.

Moreover, as explained in regard to FIG. 13 and FIG. 14, charges after the self erase discharge D33 is generated at the end (falling) of the bulk reset pulse P21 are used, the auxiliary pulse P22 for such purpose must be impressed before the charges generated disappears later. Since the charges after the self erase discharge is generally reduced in the order from one digit to two digits within the period of 1 to 3 $\mu$s from the end (falling) of the bulk reset pulse P21, the time t11 having passed from the end (falling) of the bulk reset pulse P21 must be set in the range of 1 to 3 $\mu$s. Moreover, since the charges which may be used effectively as the wall charges are not left in such a time as several $\mu$s, it is preferable that the pulse width t22 is set to about 5 to 30 $\mu$s. Here, the reason why t11 is set 1 $\mu$s or more is that if the time interval is smaller than such value, interference may be generated due to discharge time lag of self discharge. Moreover, the pulse width t22 should require the time width of about 5 $\mu$s or more to collect charges within a certain period of time. However, this pulse width t22 is not limited to such value because the required time width is different depending on the cell structure.

Operations of the present invention in the bulk reset period 41*a* in the subfield 41 in FIG. 7 have been explained above and the same operations are also conducted even in the second subfield 42 to eighth subfield 48. However, in this case, the auxiliary pulse P22 is impressed, in place of the bulk reset pulse P21, after the end (falling) of impression of the selective reset pulse P36 to the X electrode 22. Function of the auxiliary pulse P22 in the subfields 42 to 48 after the second subfield is similar to that explained above and therefore the same explanation will be omitted here. Function of the auxiliary pulse P22 in the second subfield 42 is illustrated in FIG. 11D and light emission by erroneous discharge generated when the negative scan pulse P26 is impressed to the Y1 electrode 23 is also indicated by a broken line D34 for the reference in the case where the auxiliary pulse P22 of the present invention is not impressed.

In addition, time interval t11 between the bulk reset pulse P21 or selective reset pulse P36 and the subsequent auxiliary pulse P22 in the present invention is kept constant, as explained above within the range of 1 to 3 $\mu$s. However, this time t11 can also be changed depending on the number of sustain pulses in the immediately preceding subfield. Thereby, since amount of charges in the display cells is rather small when the sustain discharge occurs in the reduced number of times in the immediately preceding subfield, the impression timing (namely, t11) is approximated to the bulk reset pulse P21 or selective reset pulse P36 (namely to about 1 $\mu$s). On the contrary, when the sustain discharge occurs many times in the immediately preceding subfield, since a large amount charges exist in the cells, it is not required to approximate the impression timing (namely, t11) to the pulses but the impression timing t11 is approximated to 2 or 3 $\mu$m in order to control the amount of charges to be collected.

In above embodiments, a technique to impress the auxiliary pulse P22 to the X electrode 22 among the electrodes forming the display cells is disclosed to prevent erroneous discharge by the scan pulse. P36, however the present invention is not limited thereto. Namely, as explained above, in order to prevent erroneous discharge by the scan pulse P26 impressed to the Y electrode 23 for selecting the light emission cells in the address period, impression voltage of the scan pulse P26 to this Y electrode 23 is lowered. Therefore, as is also illustrated in the accompanying FIG. 16, such purpose can also be realized by impressing the negative auxiliary pulse P22' illustrated in the figure to the Y electrode 23 after impression of the bulk reset pulse P21 or selective reset pulse P36.

In this case, as is apparent from FIG. 14, since the negative auxiliary pulse P22' is impressed to the Y electrode 23, charges (positive charges) generated by the self discharge D33 or D38 generated by the bulk reset pulse P21 or selective reset pulse P36 are collected under the dielectric layer 26 (in more practical, at the lower surface of the protection layer 27 under the Y electrode 23) at the area near the Y electrode 23. The voltage of the scan pulse P26 impressed to the Y electrode 23 can be lowered. Moreover, in regard to the time interval t11 for impressing the auxiliary pulse P22' to be impressed to the Y electrode 23 and the pulse width t22, these are similar to those explained above and it is preferable to set these values in the ranges of 1 to 3 $\mu$s and 5 to 30 $\mu$s. Moreover, it is also possible for the time t11 to be changed depending on the number of sustain pulses in the immediately preceding subfield.

In the embodiments, the structures for using a plurality of reset pulses and auxiliary pulse are individually provided but a new structure including the structures explained above, namely the structure for impressing first a plurality reset pulses and then impressing the auxiliary pulse can also be introduced.

As is obvious from above detail explanation, according to the present invention, erroneous operation resulting from crosstalk between the vertical neighboring display cells due to higher definition of image and fine structure of cell can be prevented and erroneous operation of light emitting cells due to erroneous discharge of cells by the scan pulse can also be prevented by reducing fluctuation of discharge time lag during the bulk reset discharge.

The present invention allows the other changes and modifications without departure from the sprit or the principal characteristics thereof. Therefore, the above embodiments shall be only examples of the present invention in every aspect and shall not be limited thereto. The scope of the present invention is suggested only by the scope of the appended claims. In addition, any change or modification within the equal range of the claims shall be within the scope of the present invention.

What is claimed is:

1. A display panel driving method for displaying images on a display panel using subfields, said display panel driving method comprising:

a reset operation step for supplying a reset pulse to an electrode of cells during a subfield period for performing the reset operation;

an auxiliary operation step for supplying an auxiliary pulse having a voltage lower than that of said reset pulse to said electrode of cells to which said reset pulse is supplied after supply of said reset pulse for generating electrical charges whose potential is inverse to a potential of a scan pulse; and an address operation step for selecting cells to be discharged for display after executing said auxiliary operation.

2. A display panel driving method according to claim 1, wherein said auxiliary pulse is supplied within the time of 1 to 3 $\mu$s from the end of supply of said reset pulse.

3. A display panel driving method according to claim 2, wherein said auxiliary pulse is supplied corresponding to the number of times of immediately preceding display discharges.

4. A display panel driving method according to claim 1, wherein said auxiliary pulse had the width of 5 to 30 $\mu$s.

5. A display panel driving method according to claim 1, wherein said auxiliary pulse is supplied to the same electrode as that to which said scan pulse is supplied.

6. A discharge type display apparatus for displaying images on a display panel by executing a reset operation and an address operation with discharging, comprising:

a drive circuit for supplying an auxiliary pulse having a voltage lower than that of a reset pulse to an electrode of cells to which said reset pulse is supplied after supply of said reset pulse for said reset operation fez forming electrical charges whose potential is inverse to a potential of a scan pulse supplied during said address operation.

7. A discharge type display apparatus according to claim 6, wherein said auxiliary pulse is supplied within the time of 1 to 3 $\mu$s after the end of impression of said reset pulse.

8. A discharge type display apparatus according to claim 6, wherein said auxiliary pulse is supplied in the timing corresponding to the number of times of immediately preceding display discharge.

9. A discharge type display apparatus according to claim 6, wherein said auxiliary pulse has the width of 5 to 30 $\mu$s.

10. A discharge type display apparatus according to claim 6, wherein said auxiliary pulse is supplied to the same electrode as that to which said scan pulse is supplied.

11. A discharge type display apparatus for displaying images on a display panel using subfields, and conducting a reset operation and an address operation with discharging, comprising.

a drive circuit for supplying a plurality of reset pulses per one of the subfield for the reset operation to an electrode of cells of the display panel during the subfields period for said reset operation, and for supplying an auxiliary pulse to said electrode of cells aster the supply of said reset pulse for said reset operation for forming electric charges whose potential is inverse to a potential of a scan pulse supplied during said address operation.

12. A discharge type display apparatus for displaying images through selection of cells to be discharged for display after a reset operation, comprising:

a display panel for displaying the images thereon having an electrode of cells for supplying with a reset pulse; and a drive circuit for supplying a preliminary process pulse for the selection of cells to said electrode during a period after supply of a first said reset pulse but before the selection of cells.

13. A discharge type display apparatus for displaying images using subfields, comprising:

a drive circuit for generating a plurality of reset pulses per one of the subfields for a reset operation; and a display panel for displaying the images thereon having an electrode of cells for supplying with a plurality of said reset pulses during a subfield period for said reset operation.

14. A discharge type display apparatus for displaying images by executing a reset operation and an address operation with discharging, comprising:

a display panel for displaying the images thereon having an electrode of cells responsive to a reset pulse for executing the reset operation; and a drive circuit for supplying an auxiliary pulse to said electrode after said reset pulse for forming electrical charges whose potential is inverse to a potential of a scan pulse supplied during the address operation.

15. A discharge type display apparatus for displaying images using subfields, and conducting a reset operation and an address operation with discharging, comprising:

a drive circuit for generating a plurality of reset pulses per one of the subfields for the reset operation and for generating an auxiliary pulse after said reset pulses for the reset operation; and a display panel for displaying the images thereon having an electrode of cells for supplying with a plurality of said reset pulses during a subfield period for the reset operation and for supplying with said auxiliary pulse for forming electric charges whose potential is inverse to a potential of a scan pulse supplied during the address operation.

* * * * *